US006601394B2

(12) United States Patent
Tatter

(10) Patent No.: US 6,601,394 B2
(45) Date of Patent: Aug. 5, 2003

(54) STORAGE CONDITION CONTROLLER

(76) Inventor: Jordan B. Tatter, 7275 Beechwood Cir., Watervliet, MI (US) 49098

( * ) Notice: Subject to any disclaimer, the term of this patent is extended or adjusted under 35 U.S.C. 154(b) by 65 days.

(21) Appl. No.: 09/751,162

(22) Filed: Dec. 29, 2000

(65) Prior Publication Data

US 2001/0045096 A1 Nov. 29, 2001

Related U.S. Application Data

(60) Provisional application No. 60/173,913, filed on Dec. 29, 1999.

(51) Int. Cl.[7] ..... F25B 49/02

(52) U.S. Cl. ..... 62/127; 62/126

(58) Field of Search ..... 62/125, 126, 127, 62/129, 130, 199, 200, 161, 162, 163, 164

(56) References Cited

U.S. PATENT DOCUMENTS

| | | | |
|---|---|---|---|
| 2,368,294 | A | 1/1945 | Giffard |
| 2,691,872 | A | 10/1954 | Schaefer |
| 2,986,009 | A | 5/1961 | Gaysowski |

(List continued on next page.)

FOREIGN PATENT DOCUMENTS

| | | |
|---|---|---|
| DE | 9213106 | 4/1993 |
| DE | 9213106.9 | 5/1993 |
| DE | 19743752 | 4/1999 |
| DE | 29903032 | 5/1999 |
| DE | 299 03 032 | 5/1999 |
| EP | 0142688 | 5/1985 |
| EP | 0189207 | 7/1986 |
| FR | 2630198 | 10/1989 |

OTHER PUBLICATIONS

"Whirlpool to Launch Internet–Ready Refrigerator" by Scott Thurm and Mark Tatge, Jan. 12, 1999, 1 page.
"Benefits of Refrigerating Foods" by Michael P. Doyle, Center for Food Safety and Quality Enhancement, University of Georgia, Feb. 7, 1999; pp. 1–15.
"Regrigerated & Frozen Food' Coverage of Supply Chain Trends", by Arthur St. Onge, Refrigerated Food, Aug. 1999, pp. 69–76.
"Avoid Chilling Injury" by Jim Rushing and Adriana Dinamarca, Fruit Grower, Aug. 1999, pp. 7–8.
Fletcher, June, "New Kitchen Applicances: You Talkin' to Me?", Jan. 2, 2000, Wall Street Journal.
Eliasohn, Michael, "Online grocery shopping still has some bugs", Jan. 21, 2001, The Herald–Palladium, p. 12C.
Green, Juanita, "kitchen help: Internet–Linked Appliances will be common in the future", Oct. 29, 2000, The Herald–Palladium, Section C.

(List continued on next page.)

*Primary Examiner*—Harry B. Tanner
(74) *Attorney, Agent, or Firm*—Baker & Daniels

(57) ABSTRACT

A refrigerator as disclosed having a housing and an external control panel with a display for displaying storage conditions in individual or multiple compartments of the refrigerator. The controls may be programmed to set optimum conditions for the food product stored in a given compartment of the refrigerator and programmable electronic circuitry includes precise controls for controlling the storage conditions within multiple compartments. The mechanism disclosed allows food products to be stored within their optimum range of conditions to reduce the deterioration of quality and prevent the development of deleterious organisms. By providing the ability to monitor conditions on the external display and adjust the conditions in a singular or multiple zones or multiple compartments of the refrigerator, users are afforded a means to increase their control for preserving food, maintaining quality, preventing food born illnesses, and conserving energy.

14 Claims, 6 Drawing Sheets

U.S. PATENT DOCUMENTS

| | | | | | |
|---|---|---|---|---|---|
| 4,014,178 | A | | 3/1977 | Kells | |
| 4,148,194 | A | | 4/1979 | Kells | |
| 4,358,932 | A | | 11/1982 | Helfrich, Jr. | 62/126 |
| 4,439,998 | A | * | 4/1984 | Horvay et al. | 62/200 X |
| 4,646,528 | A | * | 3/1987 | Marcade et al. | 62/127 |
| 4,713,532 | A | | 12/1987 | Knowles | 235/467 |
| 4,858,443 | A | | 8/1989 | Denpou | 62/126 |
| 4,899,554 | A | | 2/1990 | Kato et al. | 62/442 |
| 5,029,445 | A | | 7/1991 | Higgins | |
| 5,337,576 | A | * | 8/1994 | Dorfman et al. | 62/127 |
| 5,385,032 | A | | 1/1995 | Martin et al. | 62/187 |
| 5,483,799 | A | | 1/1996 | Dalto | |
| 5,798,694 | A | | 8/1998 | Reber et al. | |
| 5,870,219 | A | | 2/1999 | Plesko | |
| 5,884,491 | A | | 3/1999 | Kim et al. | |
| 5,884,496 | A | | 3/1999 | Kim et al. | |
| 5,896,748 | A | | 4/1999 | Park | |
| 5,899,083 | A | | 5/1999 | Peterson et al. | 62/186 |
| 5,901,562 | A | | 5/1999 | Tunzi et al. | 62/229 |
| 5,924,289 | A | | 7/1999 | Bishop, II | 62/3.61 |
| 5,931,010 | A | | 8/1999 | Kim | 62/157 |
| 5,950,449 | A | | 9/1999 | Park et al. | 62/408 |
| 5,969,606 | A | | 10/1999 | Reber et al. | |
| 5,992,164 | A | | 11/1999 | Kim | 62/186 |
| 6,003,775 | A | | 12/1999 | Ackley | |
| 6,041,606 | A | | 3/2000 | Kim | 62/186 |
| 6,044,659 | A | | 4/2000 | Ji | |
| 6,055,820 | A | | 5/2000 | Jeong et al. | |
| 6,055,826 | A | | 5/2000 | Hiraoka et al. | |
| 6,073,458 | A | | 6/2000 | Kim | 62/186 |
| 6,101,819 | A | | 8/2000 | Onaka et al. | 62/125 |
| 6,101,825 | A | | 8/2000 | Park et al. | 62/186 |
| 6,102,113 | A | | 8/2000 | Cowans | 62/126 X |
| 6,119,468 | A | | 9/2000 | Seok | 62/89 |
| 6,131,812 | A | * | 10/2000 | Schneider | 235/385 |
| 6,138,460 | A | | 10/2000 | Lee | 62/89 |
| 6,138,465 | A | | 10/2000 | Fogh et al. | 62/157 |

OTHER PUBLICATIONS

Maytag, Sear Advertisement, Jun. 23–25, 2000, USA Weekend, 1 page.

Barry, Dave, "Battling wits with kitchen appliances, I'm toast, with too many buttons", Feb. 27, 2000, St. Augustine.

Barta, Patrick, "Nesting Circa 2015", Aug. 11, 2000, Wall Street Journal, p. B1.

Reid, David, "Food preservation", Nov. 1999, Ashrae Journal, pp. 40–42, 44–45.

* cited by examiner

Start
Select Food Compartment
100
Is Desired Food Product In Program?
101
No
Yes
Program Food Product In Memory
102
Program Temperature Range For Food Product
103
Select Food Product
104

STORAGE CONDITION CONTROLLER

BACKGROUND OF THE INVENTION

1. Field of the Invention

This invention relates to a storage condition controller and more particularly to a storage condition controller for monitoring and controlling a singular and/or multiple compartments in a refrigerator. The storage condition controller of this invention is also capable of storing food at optimum temperature based upon predetermined preferred storage temperatures for different foods or food groups.

2. Discussion of the Prior Art

It has long been known that chilling or freezing will aid in the preservation of food products. Recently it has been shown that storing some food products within a critical temperature range can more effectively keep harmful organisms from growing and multiplying. One such organism is a food born bacteria called Listeria monocytogenes that can cause serious illness. Ingestion of Listeria and other harmful organisms have resulted in illness and even the death of many people in the United States every year. It has been found that the risk of illness caused by Listeria and/or other harmful organisms can be reduced by rapid chilling and storing food products at a temperature between 32–40° F.

Furthermore, the Food Safety and Inspection Service of the United States Department of Agriculture reminds consumers who are at risk from illness of Listeria and/or other food borne illnesses to take extra precautions when eating certain foods including ready-to-eat foods such as lunch meat and hot dogs. One of the recommendations is to refrigerate or freeze unconsumed perishable foods within two hours of preparation and to keep foods at risk refrigerated at or below 40° F. if fresh or frozen at 0° F. or below.

On the other hand, although storing many food products in refrigerated compartments will prolong the food's usable life, excessive chilling of some fruits may cause injury and hasten spoilage. The critical temperature at which chilling injury occurs for many fruits is around 50° F. At that temperature, bananas will become brown stained when refrigerated for about 8 hours. Likewise, a peach chilled in the range of 34–45° F. will become mealy and brown within a short period of time. However, a peach may be stored successfully for several weeks by cooling it rapidly to approximately 32° F. and closely maintaining that temperature.

In particular, regarding optimal storage temperatures for various food products, Food Science Australia, a joint venture of the Commonwealth Scientific and Industrial Research Organisation (CSIRO) and the Australian Food Industry Science Centre (AFISC), identifies the following optimum storage temperatures of various food products:

| | |
|---|---|
| Meats and Poultry | 32–36° F. |
| Seafoods | 32–36° F. |
| Cured Meat | 32–38° F. |
| Milk/Dairy Products | 34–40° F. |
| Margarin/Oils | 36–44° F. |
| Fresh Vegetables | 38–48° F. |
| Fresh Fruit | 38–50° F. |
| Frozen Foods | 0° F. |

Accordingly, it would be desirable to have a refrigeration unit having one or more compartments or chambers and furthermore, a refrigerator unit having multiple fresh food compartments whereby the temperature in each compartment may be monitored and maintained independently so as to be able to store each food product at its optimum storage temperature. In addition, it would be desirable to have a refrigeration unit having an electronic display of the actual temperature and elected temperature setting for each of said compartments. Furthermore, it would be desirable to have a refrigeration unit having a programmable electronic circuit wherein a temperature range or setting for each compartment is programmed by using a display panel with input functions to select or enter the food product that is to be stored in the compartment. A number of preprogrammed settings would be preset at the factory; however, an operator or user of the refrigeration unit should be able to alter the program for the temperature setting of a food product or add temperature settings for additional food products as may be desired.

Lastly, it would be desirable to have a refrigeration unit wherein preprogrammed electronic circuitry could be used to set and monitor other conditions in the storage compartments such as humidity, air movement, light or radiant energy or any other condition desired or required to be set or displayed. It would be most convenient if the aforementioned displays and settings were available for view and setting on the exterior of the refrigerator for convenience, observation and setting of the storage compartment conditions without need to open the door of the refrigeration unit, thus conserving energy and assisting in maintaining optimum storage conditions.

Heretofore, it has been known to provide a refrigerator having multiple compartments or chambers and to provide varying temperatures in each of said compartments, including multiple compartments in the temperature ranges for fresh food. Such a refrigerator is disclosed in U.S. Pat. No. 2,986,009, to J. Gaysowski, incorporated herein by reference. The refrigerator in Gaysowski is configured with five vertically stacked compartments with each compartment being maintained at a different temperature range. The lowest compartment is designed to operate at a temperature range of 0–10° F. with the other compartments operating in the ranges of 10–20° F., 20–30° F., 30–40° F., and 40–60° F. in order of vertical ascensi refrigerator in Gaysowski attempts to maintain the desired temperature range in each compartment or chamber by using only one temperature monitoring thermistor located in the middle chamber and a single variable resistor control coupled to the chilling unit for raising or lowering the overall temperature to be maintained inside the refrigerator.

The temperature variance in the chambers of the refrigerator in Gaysowski is achieved by using panels/piles of different sizes located at the top of each chamber such that each pile includes a different number of thermocouples. The chamber with the coldest desired temperature has the smallest pile located at the top thereof having the least number of thermocouples. To correspond with the desired increase in temperature range in each ascending chamber, each consecutive pile has an increased size and number of thermocouples so that the pile at the top of the chamber with the highest temperature setting has the largest pile and most thermocouples. The piles having more thermocouples are capable of transferring more heat thereby maintaining different temperature ranges in each chamber. The refrigerator in the Gaysowski patent does not provide a means of individually displaying, monitoring, setting, or adjusting the temperature in each chamber.

It is also been known to provide a refrigeration unit having a temperature gauge and a thermostatic control on the exterior of the refrigerator, and furthermore to have separate temperature gauges and thermostatic controls for the freezer compartment and the fresh food compartment, such as disclosed in U.S. Pat. Nos. 4,014,178 and 4,148,194 to J. Kells, both incorporated herein by reference. However, the refrigerators in the patents to Kells do not offer programmable electronic circuitry for setting, monitoring and displaying the temperature in each compartment, and furthermore, the patents to Kells do not recognize the need for more than one fresh food compartment, and more particularly, the need for multiple fresh food compartments having individual monitoring and temperature control.

It is also known to put an electronic temperature display and control on the exterior of a specimen transporter as disclosed in U.S. Pat No. 5,483,799 to M. Dalto, incorporated herein by reference. The temperature control module in the Dalto patent can be used to set and store the minimum and maximum desired temperatures in the transporter's memory circuit. The temperature control module also displays the current operational status of the storage compartment. The temperature control mechanism used in the Dalto patent includes a temperature probe for sensing the temperature and a means to activate the heating or cooling functions of the unit to maintain the temperature between the minimum and maximum set temperatures. The patent to Dalto does not disclose multiple compartments or the capability of programming the transporter temperature by inputting the type of product to be stored therein.

A mechanism for controlling the temperature of a fresh food refrigerator compartment utilizing air flow from the freezer compartment is disclosed in U.S. Pat No. 5,901,562 to S. Tunzi et al, incorporated herein by reference. The Tunzi invention utilizes manual controls of the rack and pinion type to alter the air flow characteristics. Other methods of altering the temperature and air flow of a chamber in a refrigeration unit are disclosed in U.S. Pat No. 4,358,932 to R. Helfrich, Jr., U.S. Pat. No. 4,858,443 to K. Denpou, and in 5,931,010 to J. Kim, all incorporated herein by reference and all of which relate to quick chilling chambers that are not designed to maintain food products within their optimum temperature range.

Lastly in U.S. Pat. No. 2,368,294 to W. Giffard incorporated herein by reference, a refrigerator unit is disclosed having one freezer compartment and two fresh food compartments whereby one fresh food compartment is cooled by convection currents from the primary evaporating element which condenses moisture from the air in the compartment to provide a low moisture environment. The other fresh food compartment is maintained at a high humidity level by limiting the circulation of air between said compartment and the primary evaporating element. The patent to Giffard does not possess an electronic control to display, monitor and/or adjust the humidity levels in the compartments.

None of the above references disclose or suggest a refrigeration unit having multiple fresh food compartments whereby the temperature may be electronically monitored and maintained independently for each compartment. Furthermore, none of the references disclose programmable electronic circuitry whereupon the temperature setting or range of the compartment may be set and maintained by selecting the food product to be stored therein.

SUMMARY OF THE INVENTION

It is a feature of the invention to provide a refrigerator having one or more compartments. The refrigerator has a housing, a cooling mechanism contained in the housing, and a storage condition controller including programmable electronic circuitry for controlling storage conditions within the refrigerator and an electronic display capable of displaying the temperature of each of said compartments.

Another feature of the invention is that the display on the refrigerator may depict the humidity level and air movement, for at least one of said compartments.

It is also a feature of the invention that the programmable electronic circuitry includes memory circuitry containing preprogrammed optimal storage conditions for the preservation of numerous food products and wherein the display depicts the optimum storage conditions including the optimum temperature for preservation of various food products or food groups.

It is a further feature of the invention that an operator may program the electronic circuitry to include preservation conditions including temperature for additional food products and change the preprogrammed settings.

Another feature of the invention is that the cooling mechanism includes individually controllable evaporator sections or other heat management systems in each of said compartments.

Lastly, it is a feature of the invention that the storage condition controller includes at least one temperature sensor in each of said compartments for sensing the temperature therein, said temperature sensors being electrically connected to an externally visible control module and said programmable electronic circuitry contained within said module, and an input control for inputting a temperature range setting for each of said compartments and whereas the control module is electrically connected to the cooling mechanism for activating and deactivating the mechanism to maintain the temperature of each compartment in accordance with the input settings.

BRIEF DESCRIPTION OF THE DRAWINGS

The invention will be better understood on consideration given to the following detailed description thereof. Such a description makes reference to the annex drawings wherein.

DETAILED DESCRIPTION OF THE PREFERRED EMBODIMENT

This invention relates to gathering of information about conditions in a food storage compartment, transforming the information into commonly used or understood terms, displaying information and providing means to adjust the conditions to the optimum recommended conditions for a particular food group. It encompasses multiple sensors and multiple settings in multiple storage compartments of a refrigeration unit, although the controls herein described are in no way less effective for a single compartment or a single refrigerated food storage container.

Furthermore, the invention relates to a device that will aid in reducing deterioration of food quality and improving the potential to minimize disease organisms that are associated with ineffective or improper storage conditions.

Figure 1:
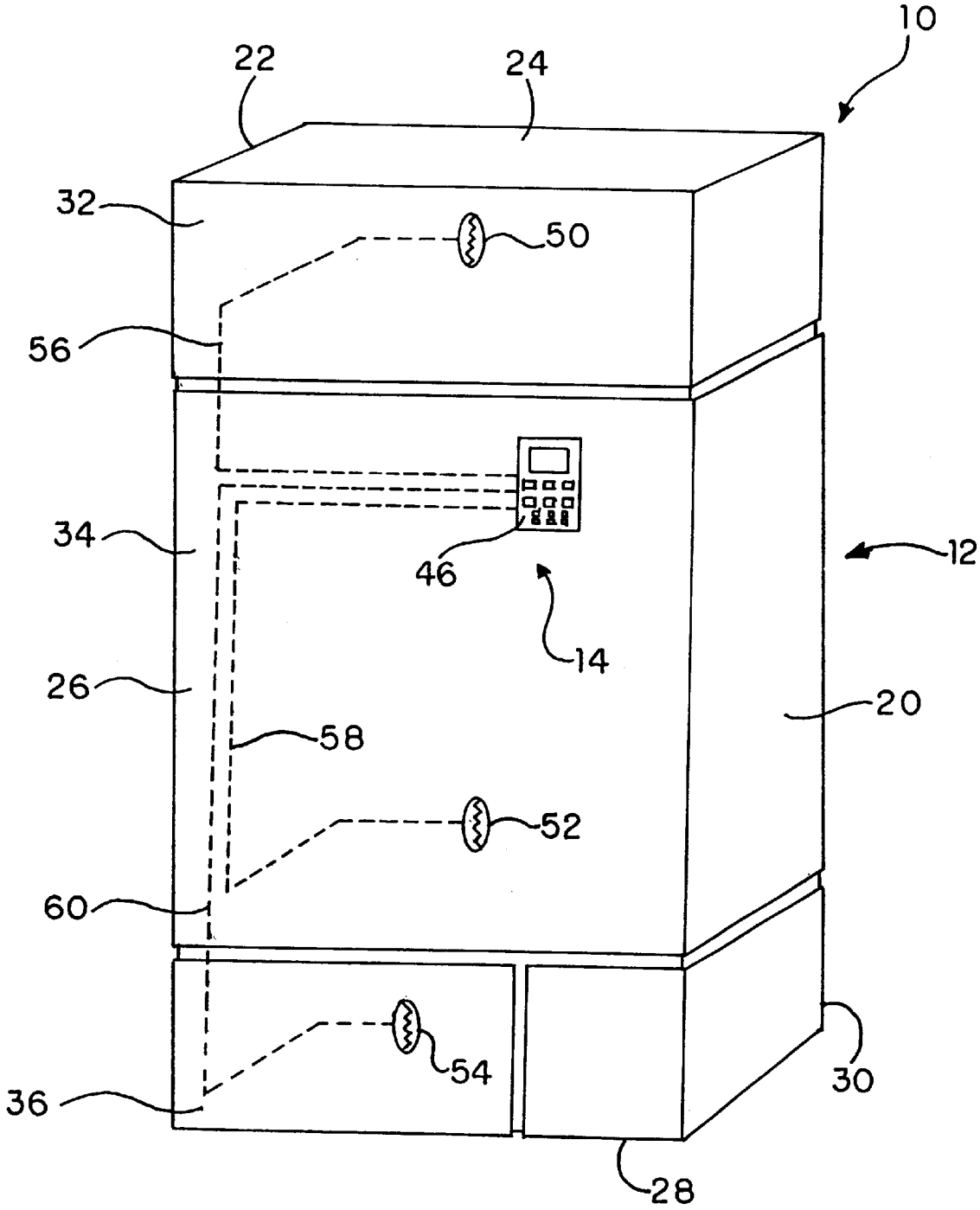
FIG. 1 is a perspective view of a refrigeration unit having multiple compartments with a central control module electrically connected with a sensor in each compartment.
Figure 2:
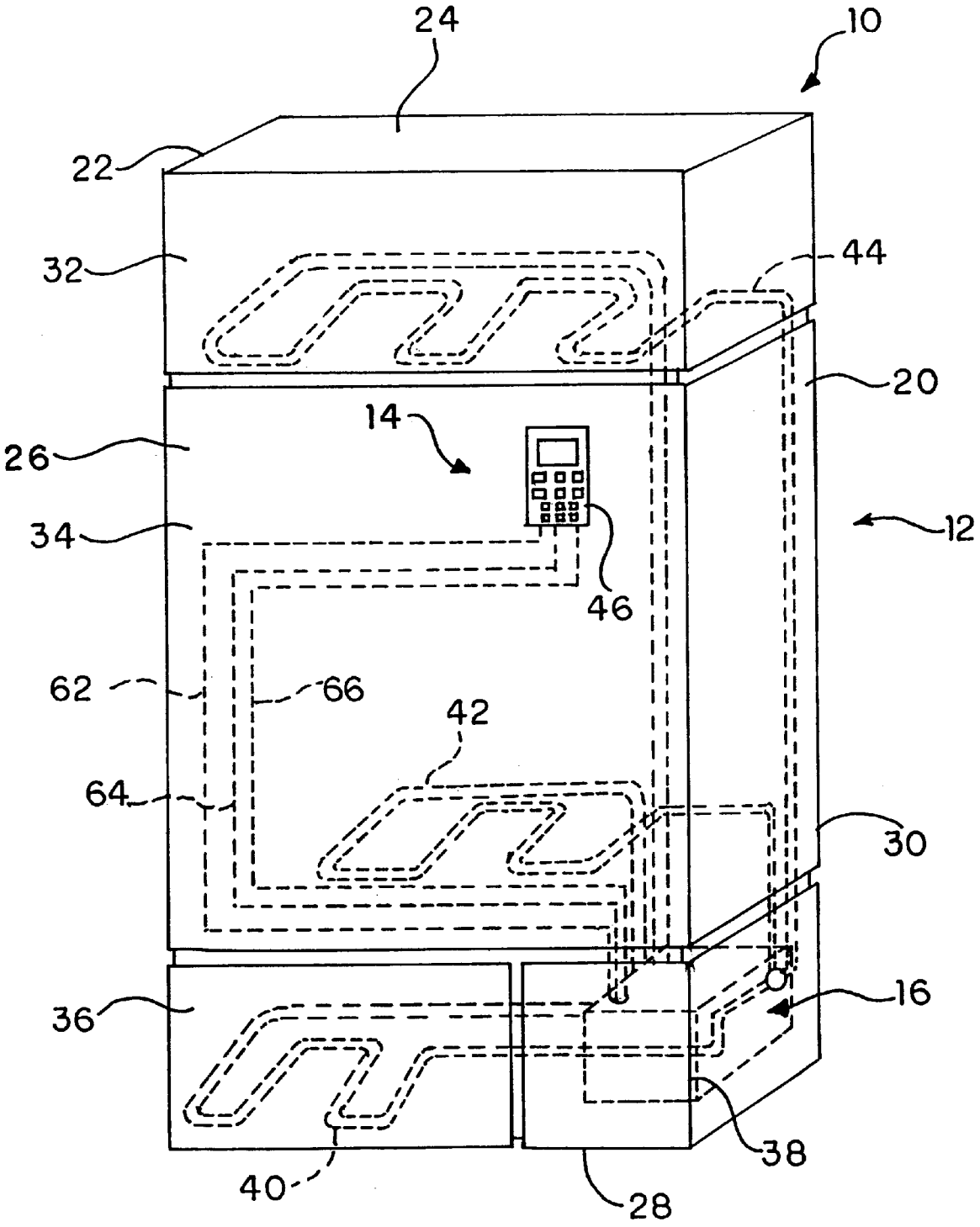
FIG. 2 is a perspective view of a refrigeration unit showing the central control module electrically connected to an internal cooling mechanism for cooling each compartment independently.

Referring now to FIGS. 1 and 2, a refrigeration unit is shown as generally indicated by 10. Refrigeration unit 10 includes a housing generally indicated by 12, a storage condition controller generally indicated by 14 and a cooling mechanism generally indicated by 16. Refrigerator housing 12 is defined by two parallel sides 20 and 22, a top 24, a front 26, a bottom 28 and a rear 30. Refrigerator unit 10 is divided into multiple compartments or chambers 32, 34, and 36, which may be thermally insulated from one another. In the embodiment depicted in FIGS. 1 and 2, compartment 32 is a freezer compartment, as is well known in the industry, and is designed to store food products or other items below their freezing temperature. Storage compartments 34 and 36 are designed to store fresh food products or other items at temperatures above their freezing temperature, such compartments also being well known in the industry.

Referring to FIG. 2, cooling mechanism 16 is of a type well known in the art and includes a compressor 38, condenser portion (not shown), and evaporation coils 40, 42, and 44. Cooling system 16 is designed with a valve mechanism (not shown) so that evaporation coils 40, 42, and 44 may be operated independently. Furthermore, cooling system 16 is designed so that evaporation coil 40 will cool compartment 36, evaporation coil 42 will cool compartment 34, and evaporation coil 44 will cool freezer compartment 32.

Referring back to FIG. 1, storage condition controller 14 includes a control module 46 and temperature sensors 50, 52 and 54, which are of a type well known in the industry. Temperature sensor 50 is located in freezer compartment 32 and has an input line 56 electrically connecting temperature sensor 50 to control module 46. Temperature sensor 52 is located in fresh food compartment 34 and is electrically connected to control module 46 by input line 58. Likewise, temperature sensor 54 is located within fresh food compartment 36 and electrically connected to control module 46 by input line 60. Control module 46 is electrically connected to cooling system 16 via output lines 62, 64, and 66 for controlling the operation of said cooling system.

Figure 3:
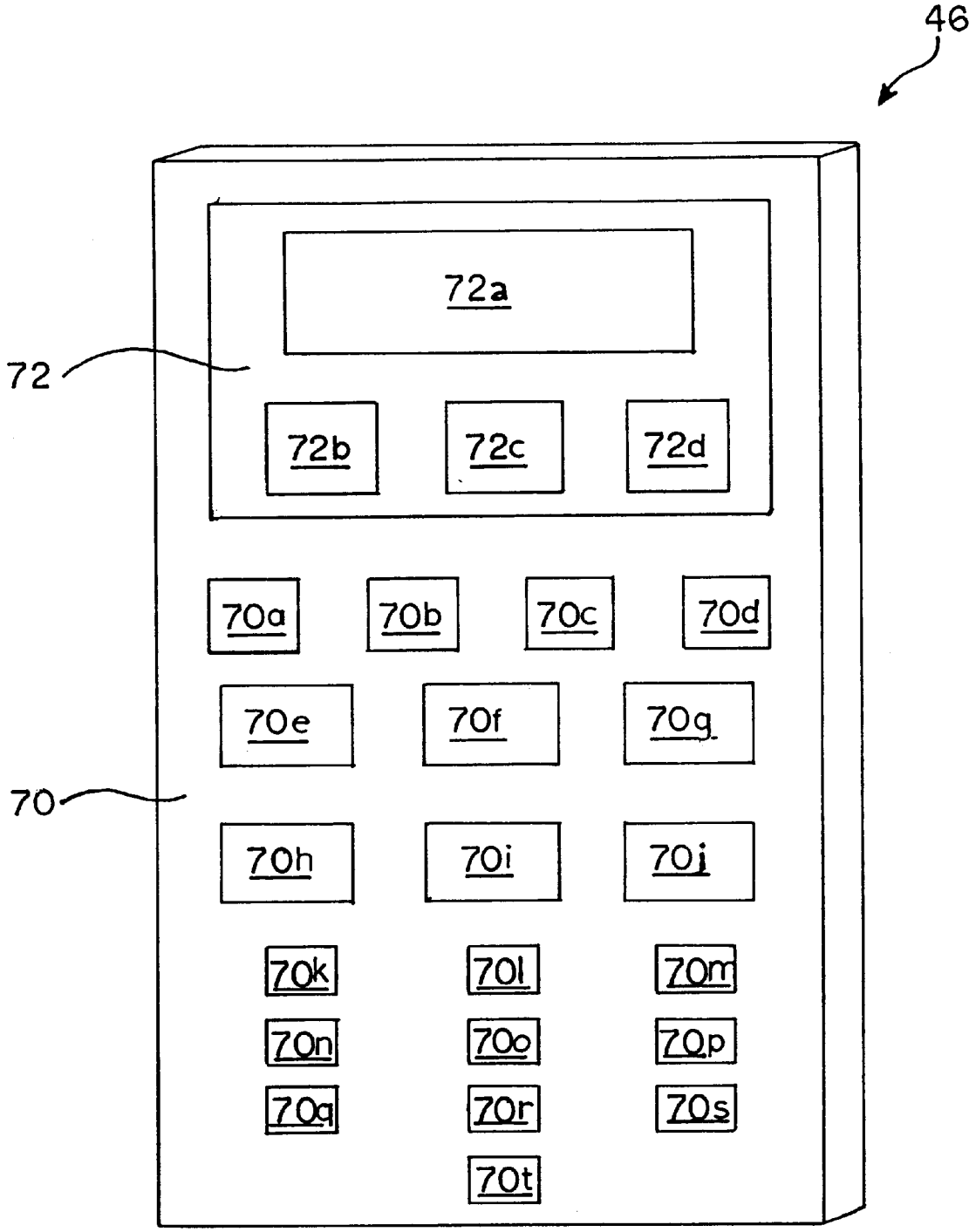
FIG. 3 is an enlarged view of the control module.

Referring now to FIG. 3, in the preferred embodiment, control module 46 includes an input portion 70 and a display portion 72. Display portion 72 is of the liquid crystal type (LED) and includes compartment number and food group displays 72*a*, a temperature display 72*b*, a humidity display 72*c* and an air flow display 72*d*. The input portion of control module 46 includes compartment selection inputs 70*a*, 70*b*, 70*c*, and 70*d* for selecting a compartment so as to read the conditions in the compartment on display portion 72 or change the conditions therein. Each compartment selection input key represents a different compartment. Also, located on the input portion 70 of control module 46 is a set condition input 70*e*, a read settings input 70*f*, a food group selection input 70*g*, a temperature selection input 70*h*, a humidity selection input 70*i*, an air flow input 70*j*, and numeric/alphabetic selection inputs 70*k–t*. Control module 46 may also include a bar code scanner so that optimum storage conditions for a food product may be encoded thereon using the Universal Product Code (UPC) and whereas the scanner reads the storage conditions encoded on the UPC and the control module sets the storage conditions of a selected compartment of the refrigerator based upon the information. The bar code scanner would be of a type widely known in the art, such as disclosed in U.S. Pat No. 4,713,532 to C. Knowles, U.S. Pat. No. 5,870,219 to G. Plesko or U.S. Pat. No. 6,003,775 to H. Ackley, all of which are incorporated herein by reference.

Figure 4:
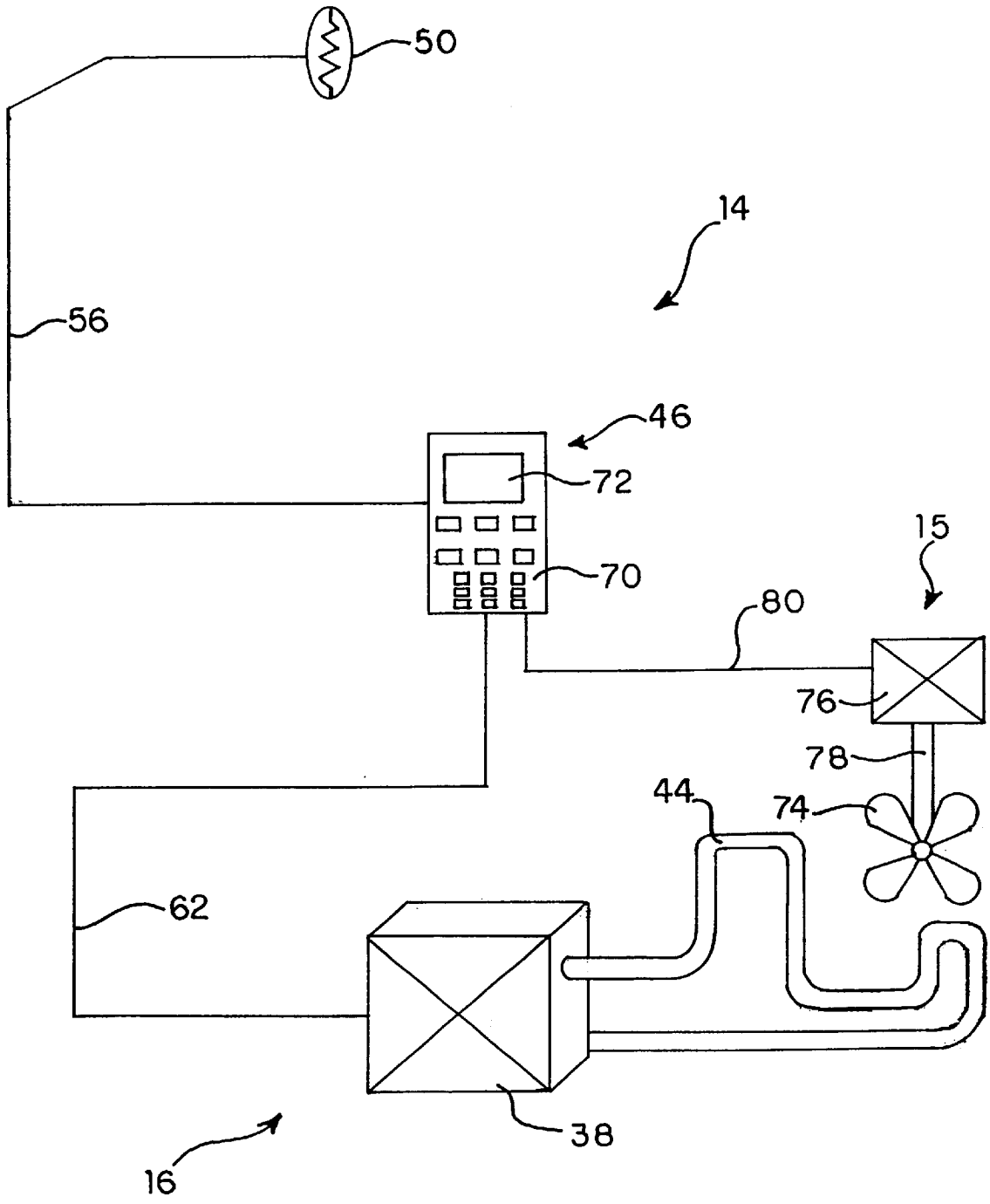
FIG. 4 shows the storage condition control loop for controlling the conditions of a single compartment.

FIG. 4 shows a portion of the storage condition controller 14 as would be associated with a single compartment or chamber of refrigerator 10, and in this Figure the controller for freezer compartment 32 is shown. Temperature sensor 50 is connected by input lines 56 to control module 46 which in turn is connected by output lines 62 to compressor 38 of cooling system 16 for cooling of the compartment by evaporation line 44. Also shown in FIG. 4 is an air flow system 15, which is also controlled by control module 46. Air flow system 15 includes a fan 74 to provide air movement wherein said fan is powered by an electric motor 76, which is coupled to fan 74 by a shaft 78. An electrical output control line 80 from control module 46 is connected to fan motor 76 to convey a control signal for activating/deactivating the fan.

Figures 5, 5A, 5B:
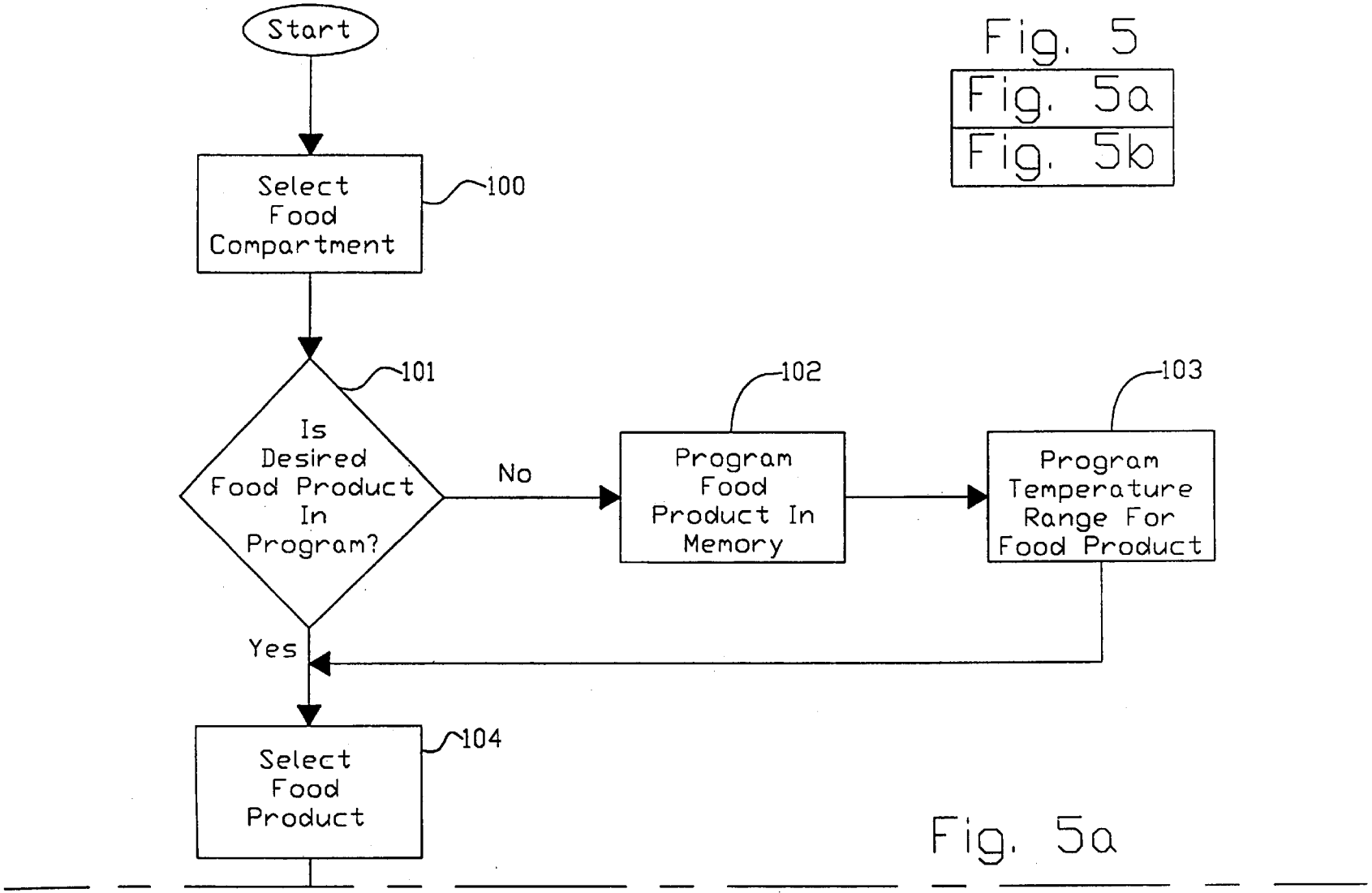
FIG. 5 shows the relationship of the charts shown on FIGS. 5*a* and 5*b*.
FIGS. 5*a* and 5*b* is a flow chart illustrating the steps for controlling the temperature of a refrigerator compartment by selecting a food group to be stored therein.
Figure 5B:
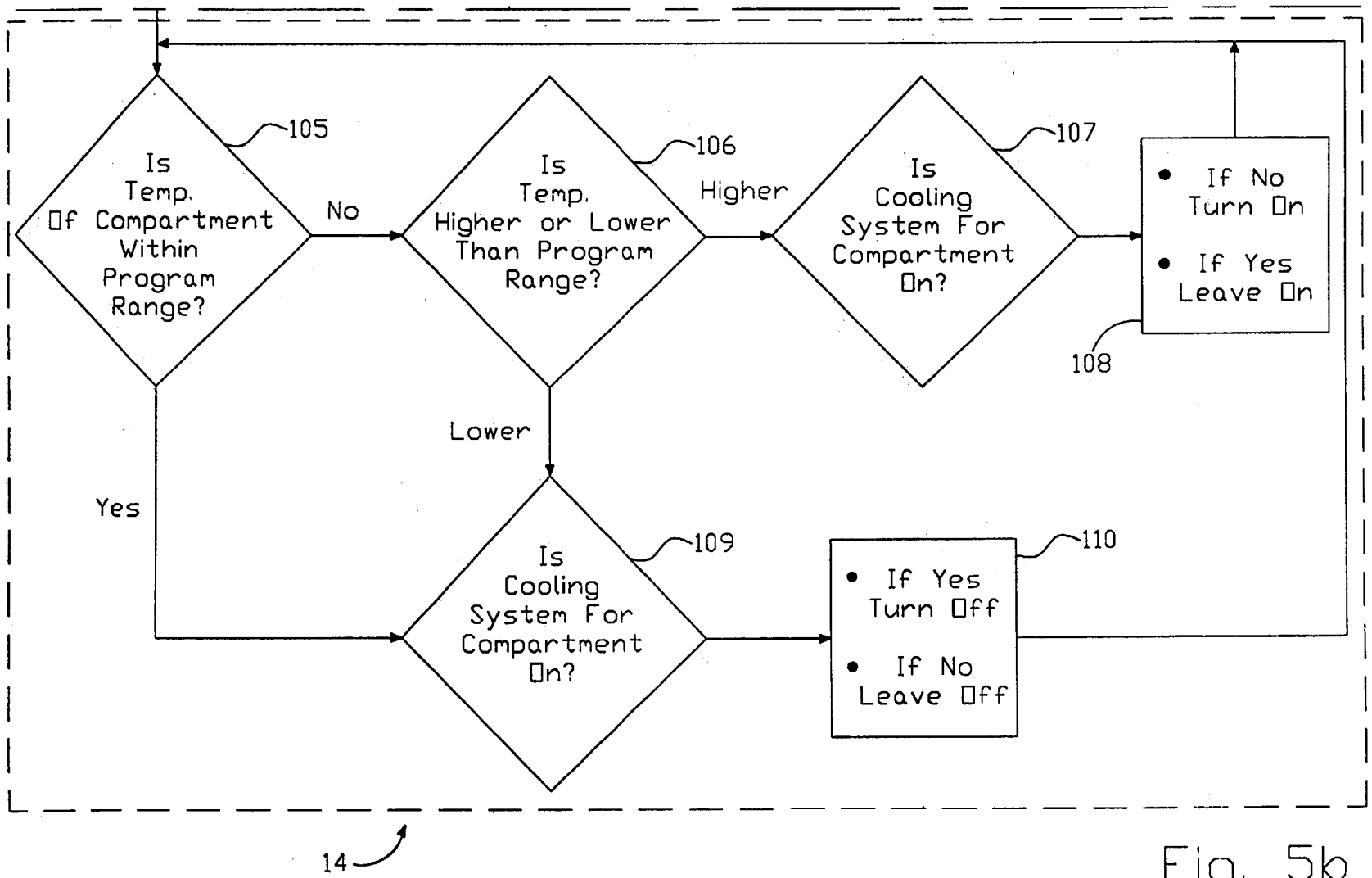

Having described the component parts of the invention, the operation will now be discussed. The operation can best be described by referring to the flow chart in FIGS. 5*a* and 5 *b*. Steps 100–104 are performed by a user and steps 105–110 are performed by storage condition controller 14. To start, a food compartment for which a food product is to be stored therein is selected at step 100 by the user opting one of the input entry keys 70*a–d*. In step 101, the user then selects input key 70*e* to determine if a programmed setting for the food product is contained within the memory of control module 46. If a program for the food product is not in the memory of control module 46, then the user may enter the food product (step 102) and a temperature range for the food product (step 103) by using the set condition keys 70*f*, temperature key 70*h* and alpha/numeric keys 70*k–t* to store the desired information in memory. After the storage conditions are programmed in control module 46, the user can now set the compartment to these conditions by touching the set condition input key 70*f* and selecting the food product to be placed in the compartment from input key 70*e* (step 104).

Once the food product is selected, storage condition controller 14 performs the necessary functions to maintain the conditions of the storage compartment within the programmed settings. Regarding the storage temperature in the compartment, in step 105 the storage condition controller senses the temperature in the compartment and determines whether the temperature is within the programmed range. If the temperature is not within the programmed range as shown in step 106, the controller will determine if the temperature is higher than the maximum temperature or lower than the minimum temperature. If the temperature in the compartment is higher than the maximum temperature for the programmed temperature range, next storage condition controller 14 will determine whether the cooling system is currently operating (step 107). As indicated in step 108, if the cooling system for the compartment in question is not on, then the storage condition controller 14 will commence the operation of cooling system 16 to cool the compartment to within the programmed temperature range for the selected food group. If the cooling system for the compartment in question is already in operation cooling the compartment, then the cooling system will remain on until the compartment temperature falls within the proper range.

If the temperature in the compartment is within the temperature range setting or is lower than the minimum temperature for the selected food group, storage condition controller 14 will again determine whether the cooling system 16 is currently in operation for the compartment (step 109). If the cooling system is in operation cooling the compartment, storage condition controller 14 will turn off the cooling system for the compartment, and if cooling system for the compartment is not currently operating, it will remain off as shown in step 110. Storage condition controller will then continue to monitor the temperature in the compartment by repeating steps 105 to 110 at a preprogrammed frequency of operation.

Storage condition controller 14 will perform similar steps for other storage conditions such as air flow or humidity which may be programmed into control module 46, such as for air flow system 15. It should be appreciated that more than one sensor may be placed in each compartment so as to provide more precise temperature monitoring. It should also be appreciated that although the refrigerator shown in the preferred embodiment includes three compartments, that any number of compartments including a single compartment or one frozen food compartment and one fresh food compartment could be used and controlled with the subject invention. Furthermore, although the refrigerator in the preferred embodiment shows controlling conditions in the refrigerator using controlled evaporator sections, any method known in the art for cooling or controlling the temperature of a refrigerator compartment may be utilized. In addition, it should be understood that any storage condition in the compartment could be controlled with the storage condition controller with the subject invention such as humidity, air flow, oxygen content, light, or otherwise using any system known in the art for regulating these conditions. It should also be recognized that the specific configuration/type of the display and input portion of the control module may be varied without departing from the scope of the invention.

While the invention has been taught with specific reference to the above embodiment, someone skilled in the art would recognize that changes can be made in form and detail without departing from the spirit and scope of the invention. The described embodiments are to be considered in all respects only as illustrative and not as restrictive. The scope of the invention is, therefore, indicated by the following claims rather than by the description.

What is claimed is:

1. A storage condition controller for independently controlling multiple compartments of a refrigerator comprising an electronic display, said display capable of displaying both a programmed set temperature and actual temperature for each of said multiple compartments; and programmable electronic circuitry, for independently programming a temperature setting for each of said multiple compartments of the refrigerator, and wherein the programmable electronic circuitry includes a plurality of food group settings and the temperature setting of each of the compartments may be set by selecting the food group to be stored therein.

2. The storage condition controller as set forth in claim 1 wherein the display is on the exterior of the refrigerator.

3. The storage condition controller as set forth in claim 1 wherein an input control for the programmable electronic circuitry is located on the exterior of the refrigerator.

4. The storage condition controller as set forth in claim 1 wherein the display includes preferred storage temperature ranges for the food groups.

5. The storage condition controller as set forth in claim 1 further comprising a control mechanism for sensing the temperature in each of said compartments and activating cooling means in the refrigerator to maintain the temperature in each of said compartments in accordance with the temperature setting.

6. The storage condition controller as set forth in claim 1, further comprising a bar code scanner.

7. A refrigerator having multiple compartments, comprising a refrigerator housing, a cooling mechanism contained in the housing, and a storage condition controller including programmable electronic circuitry for controlling storage conditions within the refrigerator and an electronic display capable of displaying the temperature of each of said compartments, and wherein the programmable electronic circuitry includes memory circuitry containing preprogrammed optimal storage conditions for the preservation of numerous food products.

8. The refrigerator as set forth in claim 7 wherein the display shows the humidity level for at least one of said compartments.

9. The refrigerator as set forth in claim 7 wherein the display shows air movement with the refrigerator.

10. The refrigerator as set forth in claim 7 wherein the display shows optimum storage conditions including the optimum temperature for preservation of various food products.

11. The refrigerator as set forth in claim 10 wherein an operator may program the electronic circuitry to include preservation conditions including temperature for additional food products and change the preprogrammed settings.

12. The refrigerator as set forth in claim 7 wherein the cooling mechanism includes individually controllable evaporator sections in each of said compartments.

13. The refrigerator as set forth in claim 12 wherein the storage condition controller includes a temperature sensor in each of said compartments for sensing the temperature therein, said temperature sensors being electrically connected to a control module and said programmable electronic circuitry contained within said module, and an input control for inputting a temperature range setting for each of said compartments and whereas the control module is electrically connected to the cooling mechanism for activating and deactivating the mechanism to maintain the temperature of each compartment in accordance with the input settings.

14. The refrigerator as set forth in claim 7, further comprising a bar code scanner.

* * * * *